US005351631A

United States Patent [19]

Hill et al.

[11] Patent Number: 5,351,631

[45] Date of Patent: Oct. 4, 1994

[54] REMOVABLE DAMPER FOR CHEMICAL RECOVERY FURNACE

[75] Inventors: Robert B. Hill, Beaverton; Daniel R. Higgins, Portland; Kenneth A. Pingel, Hillsboro, all of Oreg.

[73] Assignee: Anthony-Ross Company, Beaverton, Oreg.

[21] Appl. No.: 159,682

[22] Filed: Nov. 30, 1993

Related U.S. Application Data

[63] Continuation-in-part of Ser. No. 949,223, Sep. 23, 1992.

[51] Int. Cl.[5] ..... F23L 5/00

[52] U.S. Cl. ..... 110/182.5; 15/246; 422/185

[58] Field of Search ..... 110/182.5; 122/379; 15/246; 422/185; 266/266, 269

[56] References Cited

U.S. PATENT DOCUMENTS

| | | | |
|---|---|---|---|
| 4,423,533 | 1/1984 | Goodspeed | 15/246 |
| 5,001,992 | 3/1991 | Higgins et al. | 110/182.5 |
| 5,070,823 | 12/1991 | Ackerman et al. | 110/182.5 X |

*Primary Examiner*—Edward G. Favors
*Attorney, Agent, or Firm*—Dellett and Walters

[57] ABSTRACT

Damper apparatus for air ports of a chemical recovery furnace is mounted on a removable windbox faceplate. Damper blades extend from cantilevered arms pivoted at the forward side of the faceplate, with the damper blades being otherwise unsupported, i.e., they are not confined to travel in tracks within the windbox. Rather, a spring or counterweight urges the damper blades against the air port opening whereby the whole mechanism is free for removal as a unit with the faceplate. Cooperatively operable air port cleaning apparatus is also mounted on the faceplate.

25 Claims, 5 Drawing Sheets

REMOVABLE DAMPER FOR CHEMICAL RECOVERY FURNACE

BACKGROUND OF THE INVENTION

This application is a continuation-in-part of application Ser. No. 07/949,223 filed Sep. 23, 1992.

The present invention relates to furnaces and particularly to apparatus comprising a removable damper for an air port of a chemical recovery furnace.

Wood pulp for paper making is usually manufactured according to the sulfate process wherein wood chips are treated with a cooking liquor including sodium sulfide and sodium hydroxide. The wood chips and the cooking liquor, called "white liquor", are cooked in a digester under predetermined heat and temperature conditions. After cooking, the used liquor, termed "black liquor", containing spent cooking chemicals and soluble residue from the cook, is washed out of the pulp and treated in a recovery unit where the cooking chemicals are reclaimed. Without reclamation and reuse of the cooking chemicals, the cost of the paper making process would be prohibitive.

In the recovery process, the black liquor is first concentrated by evaporation to a water solution containing about sixty-five percent solids, which solution is then sprayed into the firebox of a black liquor recovery boiler, a type of chemical reduction furnace. The chemical reduction furnace is a reactor wherein the processes of evaporation, gasification, pyrolysis, oxidation and reduction all occur interdependently during recovery of the cooking chemicals. The organic materials in the black liquor, lignin and other wood extracts, maintain combustion in the firebox, and the heat produced melts the spent cooking chemicals. A molten smelt flows out of the furnace through a smelt spout to a collection tank. Concurrently, combustion heat is employed to generate steam in a wall of boiler tubes for use as process steam and for generating electricity.

The combustion process requires the introduction of large volumes of air into the firebox, air comprising about eighty percent of the material entering the furnace. The air is forced into the firebox from windboxes or ducts disposed at several levels in surrounding relation to the firebox, through a plurality of air ports in the walls of the furnace; while there are variations, the principal ones are primary, secondary and tertiary air ports.

The primary air ports are always the smallest and most numerous and are disposed on the four walls of the firebox near the bottom of the furnace and close to the char bed. The air supplied to the primary air ports is usually at a comparatively low pressure, and provides a portion of the air for char bed combustion and is used to control the shape and position of the perimeter of the char bed. Secondary air ports, which are generally larger and fewer in number than the primary air ports are generally disposed around the walls of the firebox higher than the primary air ports and usually below the level of the liquor spray nozzle. Air supplied through the secondary air ports is at a higher pressure than the primary and is used to control the position of the top of the char bed and to promote burning of combustible gasses rising from the char bed. Typically 65 to 80 percent of the total combustion air to the recovery boiler is introduced below the liquor spray nozzles. The tertiary air ports are located above the liquor spray nozzles and are generally larger and fewer yet in number than the secondary air ports. Air supplied through the tertiary air ports is generally at a still higher pressure to promote complete combustion and final mixing of gasses rising through the firebox.

The black liquor sprayed into the firebox, having a consistency similar to that of warm sixty weight oil, swirls, burns and falls toward the bottom of the firebox as combustion products comprising char material and smelt. The smelt and char material contact the outer walls of the firebox and, cooled by the inflowing air, form excrescent deposits around the edges of the air ports, particularly along the edges of the openings where the excrescent material builds up under influence of air rushing through the air port. Such build-ups of char material can block air flow through the ports and must be removed.

The volume and distribution of combustion air supplied to the furnace is, however, varied depending on many factors including the load of the furnace and properties of the liquor being reduced. The distribution and volume of air entering the furnace are desirably adjusted by regulating means such as dampers provided in supply ducts to the windboxes, at various locations in the windboxes, and at individual air ports for maintaining the desired air supply in all parts of the furnace. Of these three locations, the provision of regulated dampers at the air ports is most desirable. Providing dampers at individual air ports enables the independent adjustment of mass air flow and air pressure. This independence is key because mass flow is primarily determined by load while windbox pressure is determined by smelt bed conditions, furnace geometry and air/fuel mixing needs and is nearly independent of load. The mass air flow can be controlled by controlling the relative size of the port by adjusting the damper position, while air pressure can be adjusted at a supply fan and by means of dampers within supply ducts. As the damper is closed, the aspect ratio for the air port, which is ordinarily elongated, can be made to approach equal width and height dimensions for more closely simulating a round jet of air. Such a jet is advantageous at the primary air port level as well as at secondary and tertiary air port levels because it is most energy efficient which optimizes combustion control. A more efficient jet also provides better control of the smelt bed and maintains a cleaner windbox inasmuch as cleanliness of the primary windbox is primarily affected by the proximity of the smelt bed and smelt intrusion into the windbox cavity. Maintaining a higher air pressure also helps sweep the bottom of the windbox and pushes the smelt away. Ability to control the air jet from the individual air ports and operating at higher windbox pressures further enables the operator to correct for disturbances in the char bed and otherwise correct the combustion process.

An advantageous damper construction is of the sliding or guillotine type which facilitates the control of the air port aspect ratio in the manner above mentioned whereby a comparatively high pressure jet of air can be produced. Conventional guillotine dampers operate with a pivot point located inside the windbox and slide in a track proximate the air port, the operating mechanism for the damper being contained within the windbox. The air port area is subject to smelt intrusion, thermal expansion, and warping, as well as long periods without use, causing the damper mechanisms to become frozen in a particular position, particularly at the primary air port level. Removal or servicing of the damper can be difficult or impossible without closing down the furnace.

SUMMARY OF THE INVENTION

In accordance with the present invention, rather than being attached to the inside of the windbox or to the tube wall of the furnace adjacent the air port, dampers are instead supported in cantilever fashion from a windbox faceplate located on the opposite side of the windbox from the air port. This windbox faceplate is adapted for removable attachment over an opening in the forward side of the windbox and carries the damper mechanism with it when removed.

A cantilevered arm is preferably pivotally mounted to the exterior side of the faceplate but extends through an aperture in the faceplate to the interior of the windbox where the cantilevered arm is provided with a damper blade. The cantilevered arm also includes a biasing mechanism for urging the damper blade toward the air port in slidable but unattached relation to the windbox or tube wall. The position of the damper blade is controlled to be in blocking relation to a portion of the air flow through the air port in accordance with the pivotal attitude of the cantilevered arm, whereby the desired air port cross section and air flow is achieved. However, the damper blade is free to move in a direction substantially perpendicularly away from the air port so it can be moved away from the air port and so that when the windbox faceplate is removed outwardly away from the windbox, the cantilevered arm and damper blade are carried therewith such that corrective cleaning of smelt material can be accomplished. It is also found that the damper blade in accordance with this construction can be adjusted without sticking as would be the case if it were carried in a track, with the blade tending to ride up over smelt deposits as necessary until they are cleaned away.

The aforementioned cantilevered arm preferably extends from a horizontal shaft disposed on the exterior side of the faceplate which is rotated by mechanism also mounted exteriorly. Therefore, the mechanism is readily available for maintenance and adjustment.

A plurality of damper blade mechanisms are suitably mounted on the same faceplate, together with air port cleaner mechanism for rodding the air ports periodically whereby smelt build-up in the air ports can be removed. The damper blades are operated in a coordinated manner with the air port rodding apparatus whereby the dampers are periodically fully opened, i.e., during a cleaning sequence, and then restored to an operator preset position designed to achieve the preferred mass flow and velocity of jet through the air port.

It is accordingly an object of the present invention to provide an improved damper control for air ports of a chemical recovery furnace.

It is another object of the present invention to provide improved dampers for a chemical recovery furnace which are readily removable for cleaning or maintenance.

It is another object of the present invention to provide improved damper mechanism for a chemical recovery furnace which is readily adjustable to different air mass flow settings.

It is a further object of the present invention to provide an improved removable damper for a chemical recovery furnace which is adaptable for primary air port use.

It is another object of the present invention to provide an improved combination damper and cleaning device for ports of a chemical recovery furnace.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

DETAILED DESCRIPTION

Figures 1, 2:
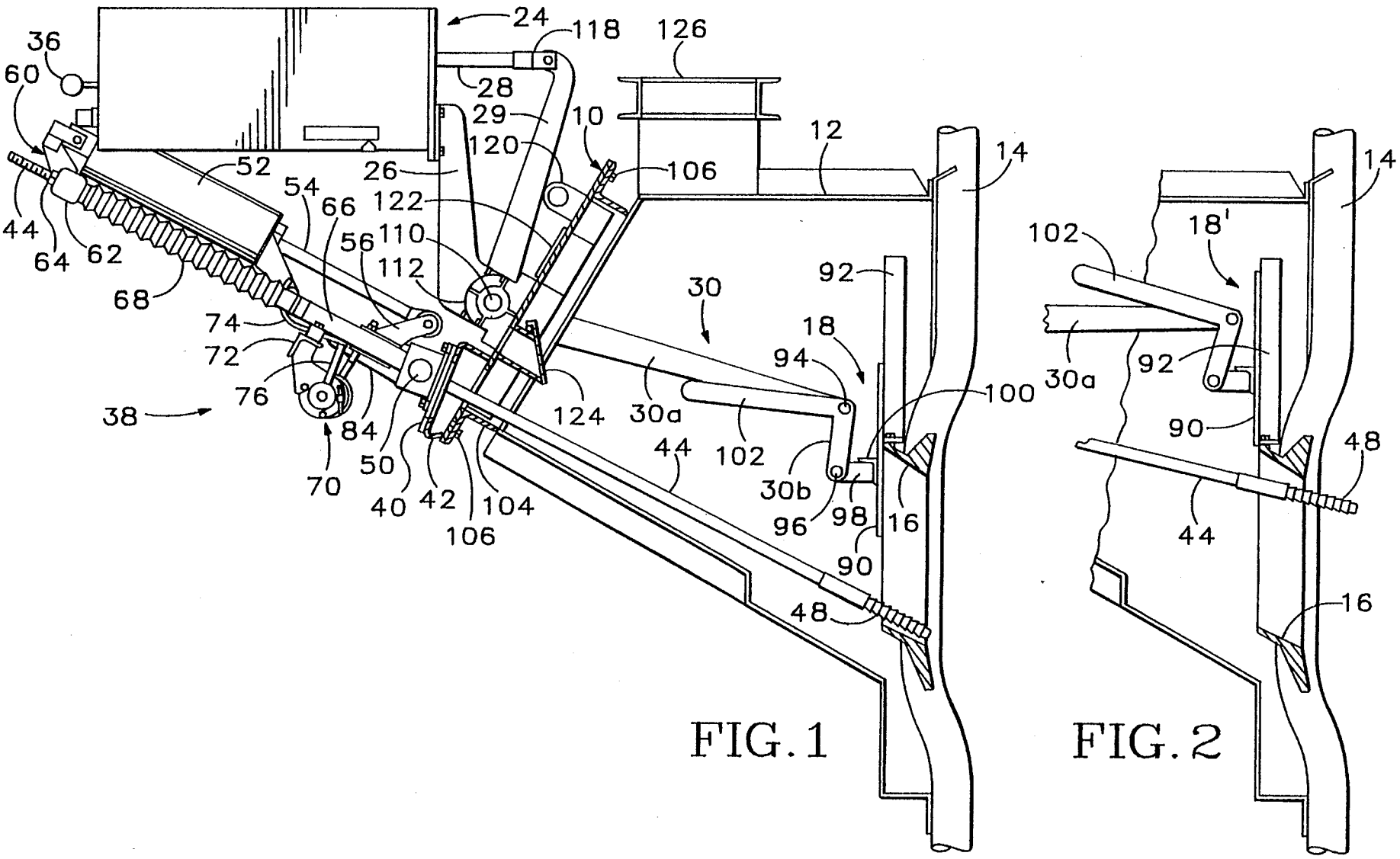
FIG. 1 is a side view, partially in cross section, of a combination damper apparatus and cleaning device for air ports of a chemical recovery furnace.
FIG. 2 is a partially broken-away view of the same apparatus as depicted in FIG. 1, illustrating a damper blade and cleaning rod in a second position.

Referring to the drawings and particularly to FIG. 1, a combination damper and cleaning apparatus for air ports of a chemical recovery furnace is illustrated as mounted upon a common, removable windbox faceplate 10 of a windbox 12. Adjacent the windbox and within the firebox of the furnace are positioned a plurality of boiler tubes 14. Air ports 16 defined by cast metal frames are located for passing quantities of combustion air from the windbox outwardly into the firebox between the boiler tubes.

Damper means 18, which is hereinafter more fully described, is adapted for regulating the air passing through the air ports by selectively blocking off portions of the air ports. The combustion air passes vertically into the windbox 12 from a supply duct thereabove via a feed duct 126 and beneath the damper through air ports 16. In the position shown in FIG. 1, the air passage is partially closed off in accordance with a predetermined adjustment, blocking the flow of air which could pass through an air port if the damper were completely upraised. In the fragmentary view of FIG. 2, damper means at 18' is illustrated in an upraised position whereby, for example, access is provided to the air port for a cleaning rod 44 having a cleaning tip 48.

In accordance with the present invention, a damper controller 24, as more fully set forth in co-pending application Ser. No. 07/662,353 filed Feb. 28, 1991, now U.S. Pat. No. 5,167,192 issued Dec. 1, 1992, is mounted upon bracket 26 which is in turn secured to windbox faceplate 10. Damper actuator rod 28 is connected by way of damper actuator arm 29 to damper lever arms 30 for operating damper means 18 as hereinafter more fully described. The air controlling position of the damper is determined via operating handle 36 of damper controller 24.

The damper apparatus in accordance with the present invention is adapted to be employed in conjunction with an automatic air port cleaner of the general type set forth in Goodspeed U.S. Pat. No. 4,822,428 issued Apr. 18, 1989. Such cleaner, illustrated at 38, is mounted on plate 40 supported from frame 42 upon windbox faceplate 10 so that cleaning rods 44 extend into windbox 12. The remote end of each rod 44 is equipped with cleaning tip 48 used for cleaning an air port 16.

The rod 44 passes through pivot bearing 50 positioned over an aperture in plate 40 and operable to enable pivoting of rod 44 and tip 48 in a vertical direction, i.e., up and down over substantially the vertical dimension of air port 16. Pivot bearing 50 and sleeve 66 carried thereby slidably receive rod 44 so that it can be extended to the right in FIG. 1 whereby tip 48 is inserted into the air port in a direction longitudinal of rod 44. To accomplish rod extension, the apparatus 38 is equipped with an air cylinder 52 having a piston rod 54 pivotally mounted upon a bracket 56 extending angularly upwardly from a member 66. The opposite end of the air cylinder 52 is pivotally mounted upon a bracket 60 which extends angularly upwardly from bar 62 receiving the threaded inner end of each rod 44, each rod 44 being engageable by nut 64 secured against bar 62. A portion of rod 44 is covered by boot or bellows 68 to prevent contamination thereof as it slides back and forth.

An eccentric mechanism 70 is adapted for indexing the rods 44 and tips 48 to various angular positions about the horizontal axis of each pivot bearing 50. Referring to FIG. 2, rod 44 is shown in a counterclockwise or upraised position and is extended so that tip 48 protrudes outwardly through air port 16 between the boiler tubes. The eccentric mechanism 70 is capable of swinging the rod 44 whereby tip 48, having the approximate width of an air port, can clean the entire air port in the vertical direction. Typically, the tip 48 will first be in a position withdrawn to the left as illustrated in FIG. 1 and will be then extended outwardly to the right so as to clean a portion of the air port. The tip is withdrawn to the left again and indexed upwardly by mechanism 70 after which it can be extended once more to the right. Successive "ramming" operations, under control of air cylinder 52, are effective for cleaning the entire air port. The above cycle of events is repeated periodically under automatic timing control.

Eccentric mechanism 70 is supported by a bar 72 secured beneath sleeve members 66 which receive cleaning rods 44, 44' and 44''. A cam plate 74 attached to the input shaft of the eccentric mechanism 70 by radial arm 76 is positioned for engagement by roller 78 (FIG. 3) mounted on air cylinder 52 so that when air cylinder 52 moves to the left and retracts the cleaning rods, the input shaft of eccentric mechanism 70 is rotated in a counterclockwise direction. An eccentric wheel, rotated in response to this rotation via clutch means 80, is captured within ring 82 secured to arm 84 extending rearwardly and upwardly from plate 40. Consequently, as cam plate 74 is rotated a fraction of a revolution as a result of retraction of the cleaning rods, the eccentric wheel will rotate a fraction of a revolution within ring 82 and displace the cleaning rods angularly upwardly (or downwardly) to position them for the next ramming operation in the same cycle.

Figure 3:
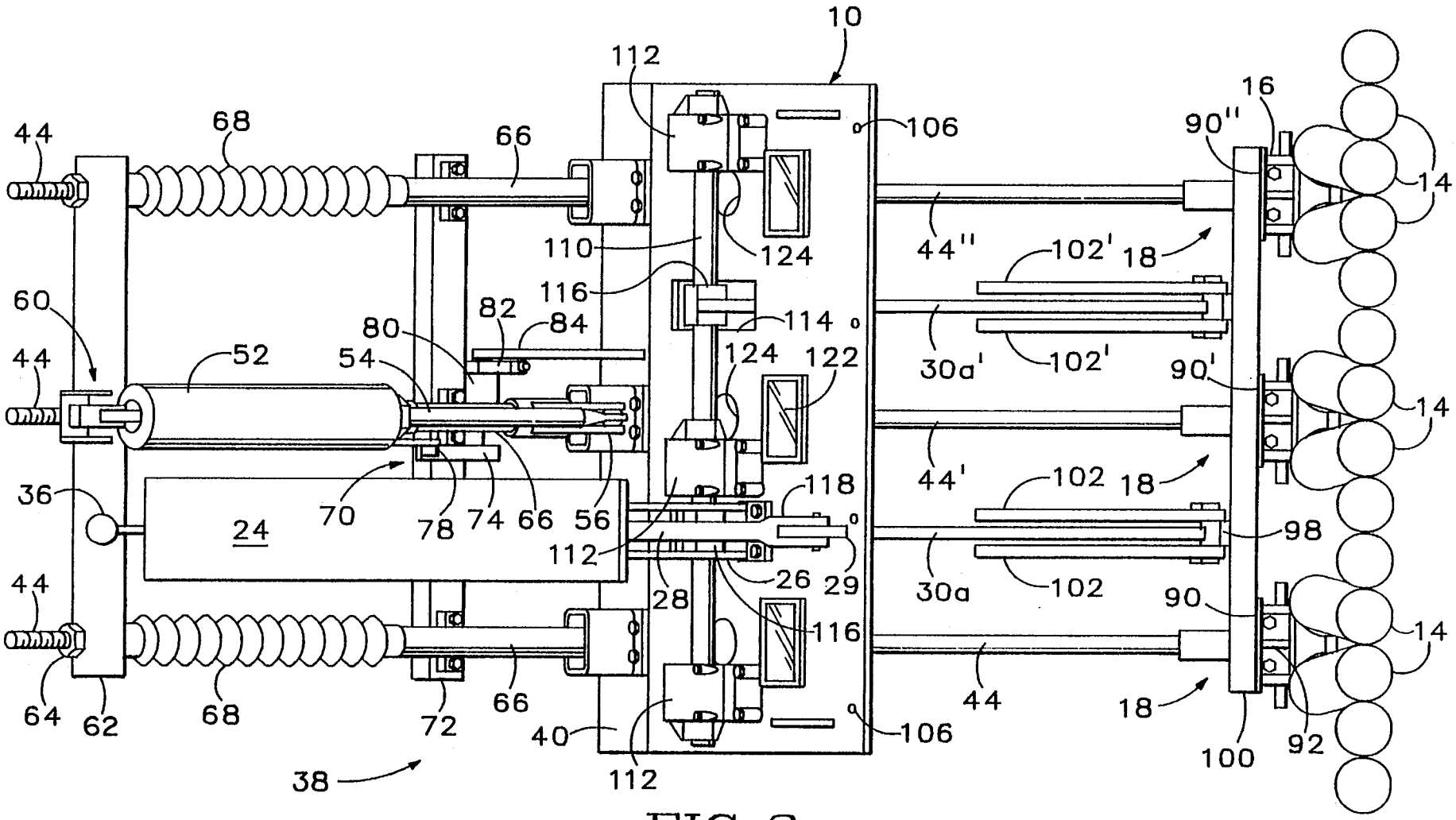
FIG. 3 is a plan view of the FIG. 1 apparatus.

As will be noted in FIG. 3, a total of three rodding mechanisms in the illustrated embodiment are mounted on one common faceplate and damping means are provided for three adjacent air ports leading from the same windbox to the furnace firebox. Also the faceplate is suitably provided with viewing windows 122 through which air ports may be observed and closable manual rodding ports 124 that enable access entry for an elongated hand-held cleaning implement, should a particular air port cleaning problem arise that cannot be taken care of by the automatically operable rods 44, or in case of equipment failure. Rodding ports 124 provide access to the dampers as well, as hereinafter more fully described.

The damper means 18 in FIG. 1 is illustrated as positioned adjacent the air ports for blocking a portion of the air flow. However, in FIG. 2 the damper means as illustrated at 18' is shown in a position withdrawn from the area immediately in front of the air ports for placing the damper means in non-interfering relation with operation of cleaning rods 44. For this purpose, damper actuator rod 28 has been translated to the left by operation of controller 24, rotating arms 30 in a counterclockwise direction for moving the dampers out of the way, in this case to a fully-open position. When the cleaning apparatus 38 has then finished a given cleaning cycle and returns rods 44 to a resting position, damper means 18 can be returned to the FIG. 1 damping position which was initially selected by handle 36.

Damper means 18 in accordance with the present invention comprise "guillotine" or vertically sliding damper apparatus, in the present embodiment comprising three vertically slidable flat metal damper blades or plates 90, 90' and 90'' that are vertically movable to cover and uncover air ports 16 disposed along the side of the windbox next to the firebox of the furnace. As illustrated, the damper blades each slide over a casting which forms the frame for each air port 16, and along a damper guide bar 92 secured at the top of each air port frame and extending upwardly therefrom to support the damper blade in its upraised position.

It will be noted that damper blades 90 are not captured in tracks but are free to move in a horizontal direction perpendicularly away from the air ports. However, the damper blades are urged toward the air port frames by damper arms 30, each damper arm 30 comprising a cantilevered arm that is pivotally mounted at the forward side of faceplate 10. The arms 30 are suitably spaced between the cleaning devices and each arm 30 is articulated, comprising a first portion **30*a* pivotally mounted to the forward side of the faceplate away from the windbox, and a second portion 30*b* connected to the first portion by pivot 94. Each second arm portion depends or extends downwardly from pivot 94 for making a connection at another pivot point 96 with a stub arm 98 extending from mounting bar 100 to which damper plates 90, 90' and 90'' are attached. In accordance with a first embodiment, arm portion 30*b* is provided with an extension 102 located on the opposite side of pivot 94 from the damper blade, the extension 102 being sufficiently heavy to provide a counterweight, wherein the combined weights of extensions 102 more than balance the weights of the damper blades 90, mounting bar 100, stub arms 98, and the depending arm portions 30*b*, considering, of course, the moment arms for each weight. Therefore, the damper blade assembly comprising the respective damper blades 90 and bar 100 is urged in a counter-clockwise direction whereby the damper blades rest against the respective air port frames and damper guide bars. The arm portions 30***b* and counterweight extensions 102 are suitably bifurcated as illustrated in FIG. 3 whereby the counterweight extensions 102 reside on either side of arm portions 30*a*. The vertical position of the damper blades 90 is dependent upon the angular position of arms 30*a* as determined by damper controller 24. However, since the damper blades are not captured in tracks, they are less likely to become lodged in excrescent material. Moreover, if excrescent material is formed at the edges of the air ports, the damper blades 90 are often able to ride up over the deposited material. More significantly, a damper blade can be temporarily swung away from an air port employing a suitable cleaning implement extended through a manual rodding port 124. Of further significance is the fact that the entire mechanism including the damper arms 30 and the damper blades 90 are removable with the faceplate 10, the latter being removably secured by fastening means 106 to frame 104 defining a forward opening in the windbox opposite the air ports. The faceplate can be uplifted by means of lugs 120. The whole apparatus comprising controller 24 and cleaner 38 can be withdrawn away from the windbox during furnace operation for servicing, cleaning or replacement as desired. The functioning of the furnace, and specific air ports thereof, thus need not be impaired by continued immovability or non-functioning of a particular damper or group of dampers. It will be further noted the cantilevered arms 30 as well as the rods 44 extend inwardly and downwardly away from the faceplate to avoid substantial interference of excrescent material with removal or servicing of the apparatus.

As the damper arms move upwardly to slide the damper blades 90 upwardly, i.e., as the arms rotate in a counterclockwise direction, each arm portion 30*b* rotates in a clockwise direction relative to arm portion 30*a* whereby the damper blades 90 move vertically along the air ports and along damper guide bars 92 to maintain contact without binding. Thus, vertical sliding movement of the damper blades is accommodated at the end of rotating arm portions 30*a* even though the latter move in an arc.

The arm portions 30*a* are secured for rotation with horizontal operating shaft 110 mounted on the forward side of the faceplate (the side opposite the air ports) by horizontally spaced bearing members 112. The arm portions 30*a* extend through apertures 114 in the faceplate and are joined to hubs 116 secured to shaft 110. Shaft 110 is in turn rotated to the desired extent by means of damper actuator arm 29 depending from clevis 118 at the end of actuator rod 28 and terminating in a hub also secured to shaft 110. The last mentioned hub suitably comprises the same hub by means of which one of the arm portions 30*a* is attached to shaft 110. It will be appreciated that maintenance and repair of the operating portions of both the damper control mechanism and the rodding cleaner mechanism may in many instances be undertaken from the exterior of the faceplate without disengaging the faceplate from the windbox since the apparatus is accessible on the exterior of the faceplate.

Figure 5:
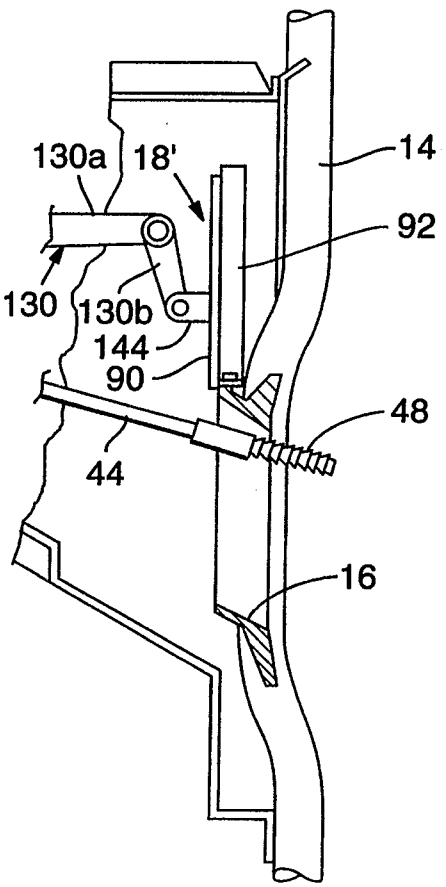
FIG. 5 is a partially broken-away view of the same apparatus as depicted in FIG. 4, illustrating a damper blade and cleaning device in a second position.
Figure 4:
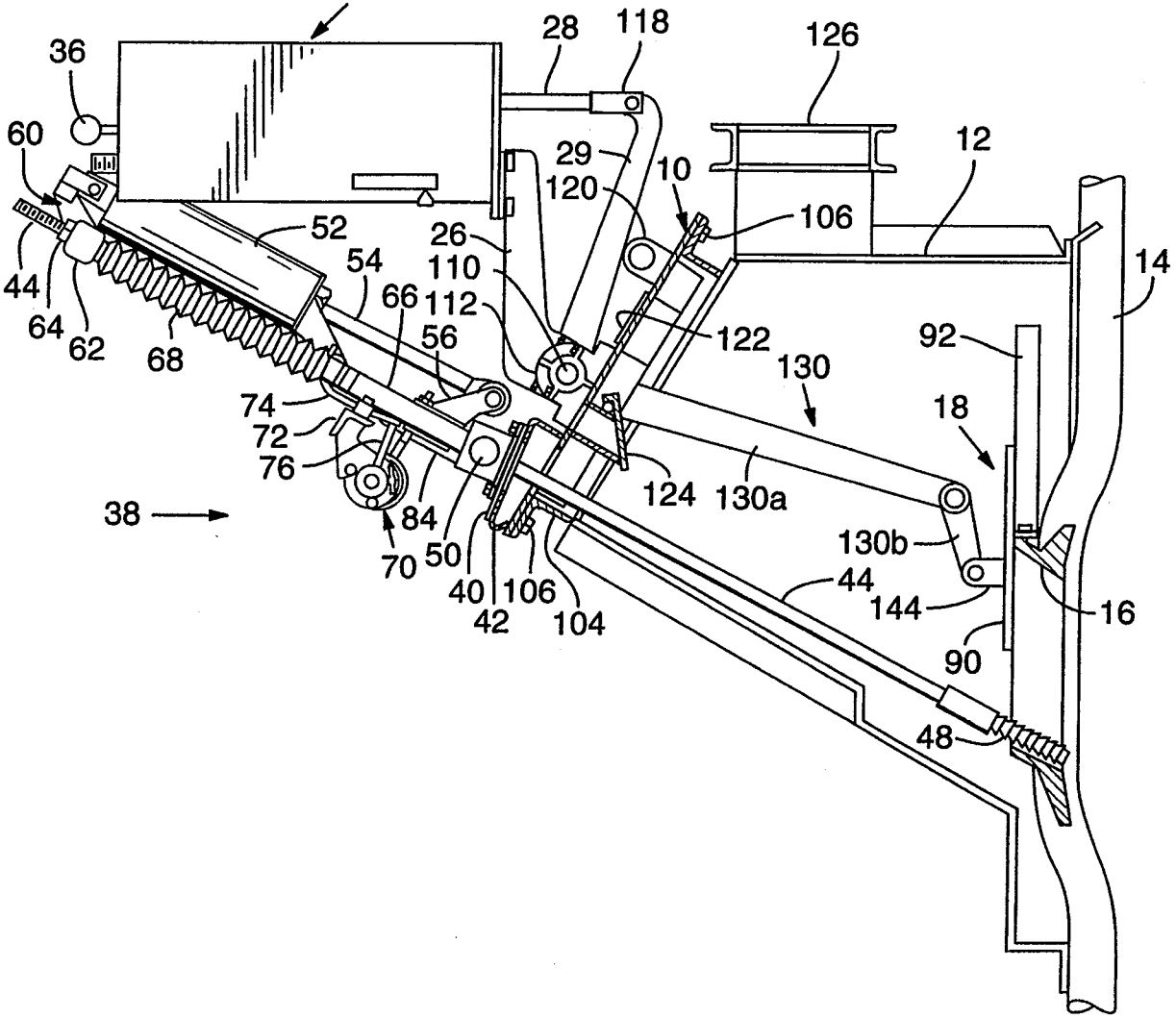
FIG. 4 is a side view, partially in cross section, of a combination damper apparatus and cleaning device according to a second embodiment of the present invention.
Figure 6:
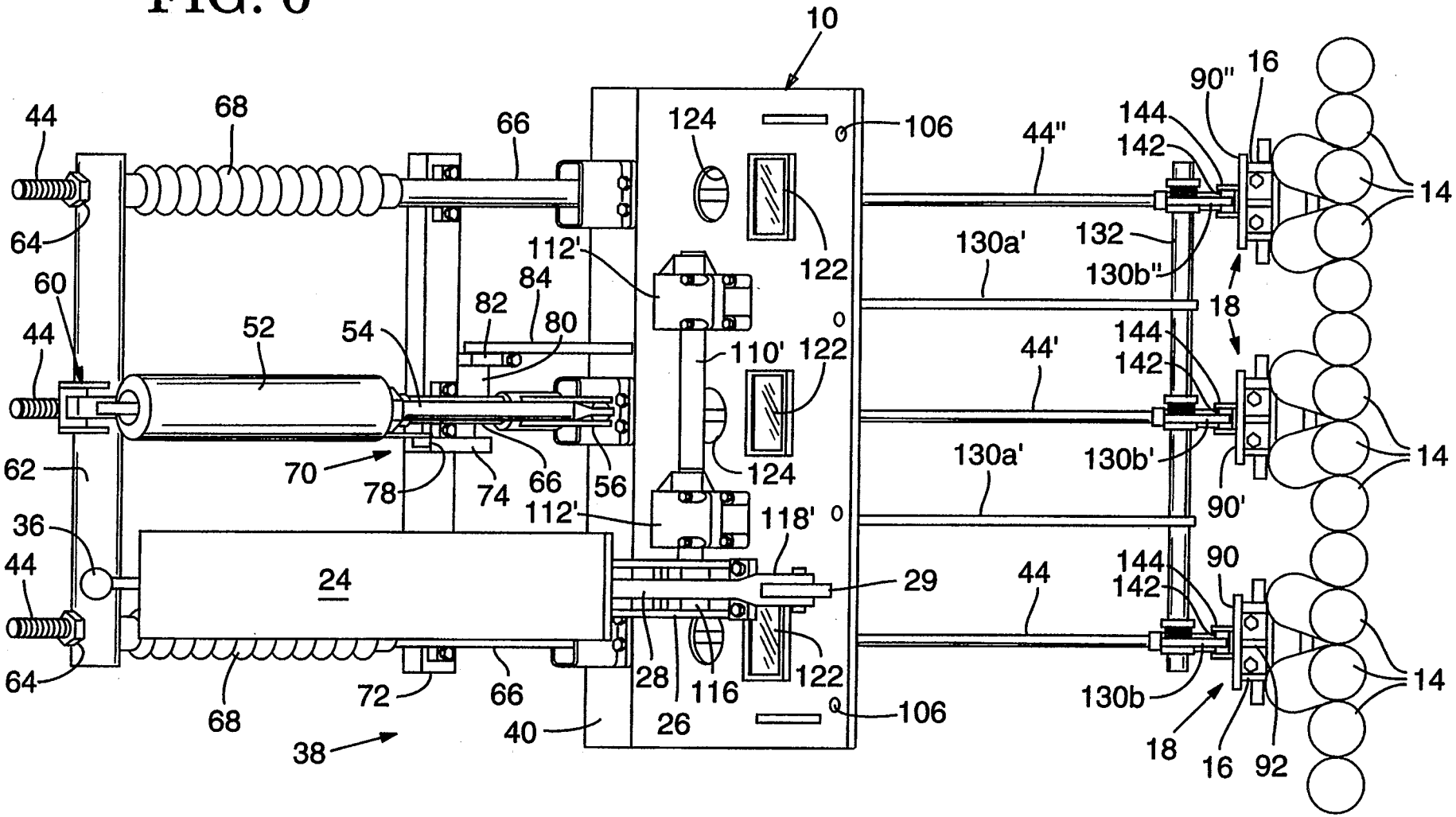
FIG. 6 is a plan view of the FIG. 4 apparatus.

A second embodiment of the present invention will be explained with reference to FIGS. 4, 5, 6, 7A and 7B. In FIGS. 4, 5 and 6, elements identified by reference numerals corresponding to those in FIGS. 1, 2 and 3 are substantially identical to those previously described. In the second embodiment, the biasing means for holding the damper blades 90 against the air port openings comprise torsional springs rather than counterweights.

In this embodiment it will again be noted that the damper blades 90 are not captured in tracks but are free to move in a horizontal direction, perpendicularly away from the air ports. The damper blades are urged toward the air port frames via the damper arms 130, each damper arm 130 comprising a cantilevered arm that is mounted for rotation via shaft 110', wherein the latter is supported between bearing members 112' that are secured to the forward side of the face plate. The bearing members 112' support the bearings for shaft 110' while also providing access for arms 130 to shaft 110' on the windbox side where the housings are open to the windbox through apertures in the face plate over which the bearing members are mounted. The bearing members 112' are closed above the face plate to lessen the outflow of air.

The arms 130 are suitably spaced between the cleaning devices, and specifically between rods 44, and are articulated to provide first arm portions 130*a* rotatable with respect to the forward side of the face plate, as well as depending counter links 130*b* that provide second arm portions laterally offset with respect to the first arm portions.

Figure 7A:
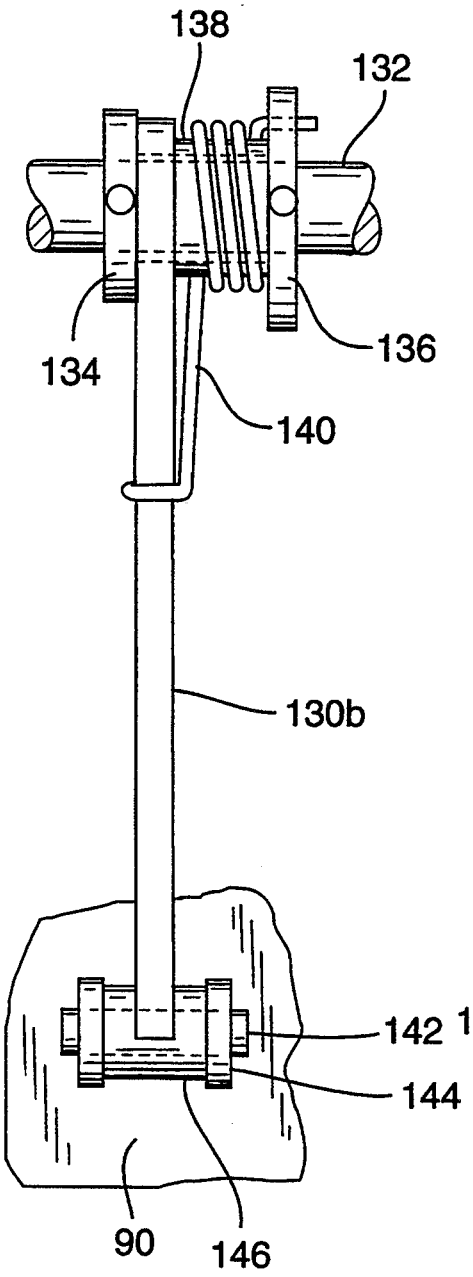
FIG. 7A is an end view, partially broken-away, of a damper counter link and biasing spring as employed in the FIG. 4 embodiment.
Figure 7B:
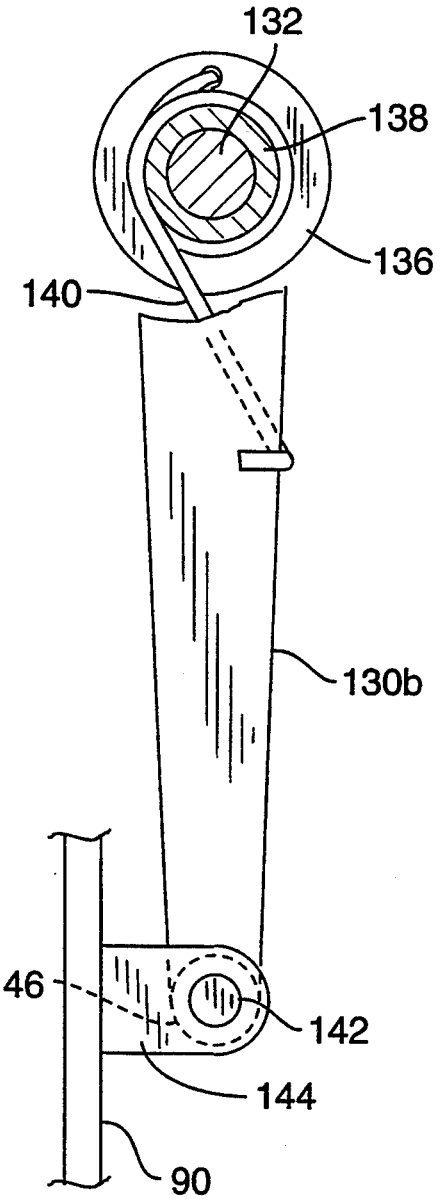
FIG. 7B is a side view, partially broken away, of the FIG. 7A counter link and biasing spring combination.

The arm portions 130*a* at their distal ends mutually support a lateral shaft 132 to which collars 134 and 136 are joined, proximate each damper counter link 130*b*. (See FIGS. 7A and 7B.) Between each pair of collars 134, 136, shaft 132 carries a hub 138 as well as the upper apertured end of counter link 130*b* at a location substantially in front of a corresponding air port opening, and between (or to one side of) arm portions 130*a*. Torsional spring 140 wraps around hub 138 with one end of the spring received through a peripheral bore in collar 136 while the other end engages the lower body of damper counter link 130*b* for urging the counter link in a clockwise direction, as the device is seen in FIG. 7B. The shaft 132 can be considered as forming part of a first articulated arm portion which thereby provides a second pivot point for the articulated arm.

Each damper counter link 130*b* is connected at its lower end to a short shaft 142 carried between ears 144 secured to a damper blade 90, each damper counter link being provided with a lower hub 146 through which a shaft 142 extends. A damper blade 90 is thereby carried at the lower end of a damper counter link 130*b*, and is rotatable about a pivot point defined by shaft 142. The torsion springs 140 urge the damper counter links 130*b* toward the air port opening and hold the damper blades in secure but sliding relation against the frame that defines the air port. The vertical position of the damper blades 90 is dependent upon the angular position of arms 130 as determined by damper controller 24. However, since the damper blades are not captured in tracks, they are less likely to become lodged in excrescent material. As hereinbefore discussed, if excrescent material is formed at the edges of the air ports, the damper blades 90 are often able to ride up over the deposited material, and a damper blade can also be swung away from the air port employing a cleaning implement extended through manual rodding port 124. Furthermore, the entire mechanism including the damper arms 130 and the damper blades 90 is removable with the face plate 10, the latter being removably secured by fastening means 106 to frame 104 defining a forward opening in the windbox opposite the air ports. The whole apparatus comprising controller 24 and cleaner 38 can be withdrawn away from the windbox during furnace operation if desired.

As the damper arms move upwardly to slide the damper blades 90 upwardly, i.e., as the arms rotate in a counterclockwise direction, each damper counter link 130*b* rotates in a clockwise direction relative to an arm portion 130*a* (for the configuration shown) whereby the damper blades 90 move vertically along the air ports and along damper guide bars 92, making contact without binding. Vertical sliding movement of the damper blades is accomplished at the end of a rotating arm even though the latter moves in an arc.

In the embodiment of FIGS. 4–7B, it will be noted that damper controller 24 together with arm 29 as connected to shaft 110' are displaced somewhat to the right compared to the first embodiment (as the apparatus is viewed by an individual facing the windbox) to accommodate the position of bearing members 112' located in line with arms 130. The damper actuator arm 29 depending from clevis 118 at the end of actuator rod 28 is secured to shaft 110' outboard from the adjacent bearing member 112'. However, the operation of the mechanism for rotating shaft 110' and moving arms 130 upwardly and downwardly is substantially the same as described with respect to the previous embodiment.

The torsional springs in this embodiment are advantageously formed of high temperature stainless steel. The springs have the advantage of being compact and are more easily replaceable to accommodate differing degrees of torque as may be required in different installations. Moreover, they are lighter to lift and present less interference with air flow. Torque may also be controlled without replacement of the torsional springs by adjustment of collar 136, which may be loosened and rotated independently of shaft 132. Once torque is adjusted to the desired level, collar 136 is then tightened to fix the torque at the desired level.

The damper counter links 130*b*, 130*b'* and 130*b''* (FIG. 6) rotate individually relative to one another thereby advantageously accommodating misalignment between the respective port casings.

In accordance with the invention, guillotine-type dampers or vertically slidable dampers are provided for primary air ports of a chemical recovery furnace and are advantageous in adjusting the air port openings for optimum air mass flow and jet velocity. The damper construction is less apt to be fouled or locked in position by excrescent material since the damper blades are not captured in slots in the windbox, and the entire mechanism is removable with the windbox faceplate inasmuch as the blades are cantilevered at the end of damper arms pivotally attached to the faceplate. The blades can also be moved away from the air ports via a rodding port in the faceplate. Furthermore, the cantilevered arms are pivotally mounted to the exterior of the faceplate whereby the rotating mechanism can be readily serviced. The damper blades are also less apt to bind since utilized in combination with automatic cleaning apparatus that not only periodically cleans the air ports but also functions on a timed basis whereby the damper blades are frequently moved and are therefore less likely to become stuck in excrescent material.

Although the present mechanism has been described with reference to primary air port application, it will be readily appreciated the same apparatus can be utilized in conjunction with secondary or tertiary air ports. While preferred embodiments of the present invention have been shown and described, it will be apparent to those skilled in the art that many other changes and modifications may be made without departing from the invention in its broader aspects. The appended claims are therefore intended to cover all such changes and modifications as fall within the true spirit and scope of the invention.

We claim:

1. Apparatus for adjusting combustion air flow into a furnace from a windbox via an air port, said apparatus comprising:

a faceplate spaced from said air port at the forward side of said windbox, a damper blade for controlling air flow, and a cantilevered arm pivotally mounted to said faceplate, wherein said cantilevered arm carries said damper blade, said arm being provided with spring means for urging said damper blade toward said air port in slidable but unattached relation thereto for controllably positioning said damper blade in blocking relation to a portion of said air port in accordance with the pivotal attitude of said arm, said damper blade being movable with said arm in a direction away from said air port to enable selective insertion and removal of said damper blade with respect to said air port.

2. The apparatus according to claim 1 wherein said cantilevered arm is articulated and comprises a first portion which is pivotally mounted to said faceplate and a second portion pivotally connected to said first portion and wherein said spring means is provided between said first and second portions for rotatably urging said damper blade in an arcuate path toward said air port.

3. The apparatus according to claim 2 wherein said damper blade is also pivotally connected to said second portion at the remote end thereof from said first portion.

4. The apparatus according to claim 1 wherein said faceplate is provided with a port for enabling manual engagement of said damper blade.

5. The apparatus according to claim 1 in further combination with a rodding device periodically extended through said air port for cleaning said air port, wherein said rodding device is also mounted to said faceplate, and further including means for causing said cantilevered arm to slide said damper blade for uncovering said air port to provide access for said rodding device.

6. Apparatus for adjusting combustion air flow into a furnace from a windbox via an air port proximate the rearward side of said windbox, said windbox also being provided with an opening in a forward side thereof, said apparatus comprising:

a faceplate adapted for removable attachment over said opening in the forward side of said windbox, a damper blade for controlling air flow, and a cantilevered arm pivotally mounted to the side of said faceplate exterior of said windbox, wherein said cantilevered arm carries said damper blade proximate an end of said arm remote from said faceplate for urging said damper blade toward said air port in slidable but unattached relation thereto for controllably positioning said damper blade in blocking relation to a portion of said air port in accordance with the pivotal attitude of said arm with respect to said faceplate, said damper blade being movable with said arm in a direction substantially perpendicularly away from said air port to enable selective insertion and removal of said damper blade through said opening in the forward side of said windbox with selective attachment and removal of said faceplate, wherein said cantilevered arm is articulated and comprises a first portion which is pivotally mounted to the exterior of said faceplate and a second portion pivotally connected to said first portion at a second pivot point, said arm further including means providing a connection with said damper blade, said second portion extending from said second pivot point to said connection, and torsional spring means disposed about said second pivot point and in engaging relation respectively with said first and second portions for urging said damper blade toward said air port.

7. The apparatus according to claim 6 wherein said second pivot point comprises a shaft.

8. The apparatus according to claim 7 wherein said first and second portions are offset from one another along said shaft, said torsional spring means being attached to said shaft for implementing the engaging relation with said first arm portion.

9. The apparatus according to claim 6 wherein said first portion of said arm is adapted to extend inwardly of said windbox and away from said faceplate.

10. The apparatus according to claim 6 in further combination with a rodding device for extending through said air port for cleaning said air port, wherein said rodding device is also mounted to said faceplate, and further including means for causing said cantilevered arm to slide said damper blade to uncover said air port to provide access to said air port for said rodding device.

11. The apparatus according to claim 10 wherein means are provided for indexing said rodding device along the vertical dimension of said air port for enabling successive thrusts of said rodding device at successive locations along the vertical dimension of said air port.

12. The apparatus according to claim 10 wherein said rodding device and said damper arm are automatically controlled for periodic cleaning operation.

13. The apparatus according to claim 6 wherein said faceplate is provided with a port for enabling remote manual engagement of said damper blade.

14. The apparatus according to claim 6 wherein said faceplate is provided on the forward side thereof with a horizontal operating shaft journaled in bearings on said faceplate, said cantilevered arm being attached to said shaft for rotation therewith.

15. The apparatus according to claim 14 further including at least an additional cantilevered arm having a portion articulated at a second pivot point and carrying a damper blade for controlling air flow through an air port adjacent the first mentioned air port, said additional cantilevered arm also being attached to said operating shaft for rotation therewith.

16. The apparatus according to claim 15 further including means also mounted to said faceplate for controllably rotating said operating shaft.

17. The apparatus according to claim 15 wherein said second pivot points comprise a second shaft disposed in substantially perpendicular relation to the first mentioned cantilevered arm and to said additional cantilevered arm, and including a further torsional spring means disposed about said second shaft and engaged respectively with said portion of said additional cantilevered arm.

18. The apparatus according to claim 17 including rodding means adapted to be extended through said air ports, first portions of said cantilevered arms being laterally offset with respect to said rodding means.

19. Apparatus for adjusting combustion air flow into a furnace from a windbox via air port means defining an opening from said windbox into said furnace, said apparatus comprising:

a faceplate spaced from said air port means at the forward end of said windbox, a damper blade disposed in slidable but unattached relation to said air port means on the side thereof toward said faceplate for controlling air flow through said air port means, and cantilevered arm means for urging said damper blade toward said air port means to hold said damper blade in said slidable relation with respect to said air port means and controllably positioning said damper blade in blocking relation to a portion of said air port means, said cantilevered arm means being pivotally mounted with respect to said apparatus and carrying said damper blade whereby said damper blade is movable with said arm means, said cantilevered arm means being provided with spring means for biasing said arm means toward said air port means for urging said damper blade toward said air port means.

20. The apparatus according to claim 19 wherein said cantilevered arm means is articulated and comprises a first portion which is pivotally mounted to said faceplate and a second portion, said second portion being pivotally connected to said first portion and wherein said spring means comprises a torsional spring interconnecting said first and second portions.

21. The apparatus according to claim 20 wherein said damper blade is also pivotally connected to said second portion at the remote end thereof from said first portion.

22. The apparatus according to claim 18 wherein said faceplate is provided with a port for enabling manual engagement of said damper blade.

23. The apparatus according to claim 19 wherein said faceplate is provided with a port for enabling manual rodding of the opening of said air port means.

24. The apparatus according to claim 19 in further combination with an automatic rodding device periodically extended through the opening of said air port means for cleaning said air port means, wherein said rodding device is also mounted to said faceplate, and further including means for causing said cantilevered arm to slide said damper blade for uncovering the opening of said air port means to provide access for said rodding device.

25. The apparatus according to claim 19 wherein said faceplate is provided with at least one viewing window for enabling viewing of said air port means.

* * * * *